United States Patent [19]

Slade

[11] 4,147,125

[45] Apr. 3, 1979

[54] STEERING AND PROPULSION MEANS FOR SHIPS OR OTHER VESSELS

[75] Inventor: Owen G. Slade, Cowes, England

[73] Assignee: Carrier Corporation, Syracuse, N.Y.

[21] Appl. No.: 814,063

[22] Filed: Jul. 8, 1977

[30] Foreign Application Priority Data

Jul. 26, 1976 [GB] United Kingdom ..... 31006/76

[51] Int. Cl.[2] ..... B63H 11/02

[52] U.S. Cl. ..... 115/14; 114/151; 60/221

[58] Field of Search ..... 60/221, 228, 230; 115/11, 12 R, 12 A, 14, 16, 39; 114/145 R, 150, 151

[56] References Cited

U.S. PATENT DOCUMENTS

| | | | |
|---|---|---|---|
| 3,397,538 | 8/1968 | Then | 115/12 R |
| 3,543,713 | 12/1970 | Slade | 115/12 R |
| 3,742,893 | 7/1973 | Stelling | 115/14 |
| 3,800,731 | 4/1974 | Slade | 115/12 R |
| 3,893,405 | 7/1975 | Lais | 115/12 R |
| 3,903,833 | 9/1975 | Lais | 114/151 |

*Primary Examiner*—Trygve M. Blix
*Assistant Examiner*—D. W. Keen
*Attorney, Agent, or Firm*—J. Raymond Curtin; Barry E. Deutsch

[57] ABSTRACT

A propulsion unit for a vessel of the type having a compartment watertightly sealed from the remainder of the vessel. The propulsion unit includes a cylindrical housing vertically supported within the compartment. A pump havin a drive shaft is supported within the housing, the drive shaft extending into the housing coaxial therewith. A deflector is rotatably supported at the outlet of the housing about an axis coaxial with the axis of the drive shaft.

14 Claims, 1 Drawing Figure

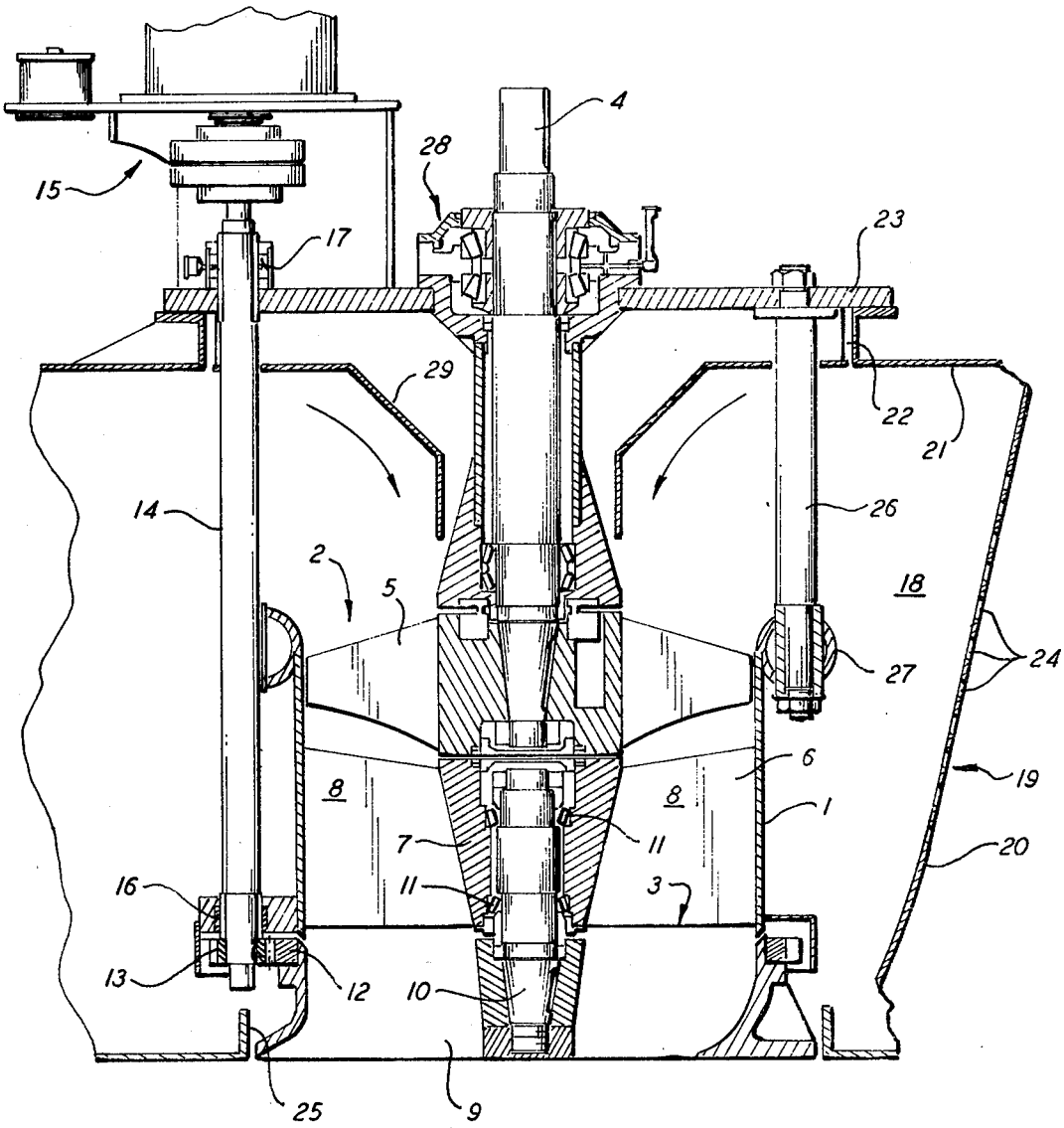
4
28
15
17
23
29
22
21
14
26
2
5
18
24
27
6
19
8
8
1
7
11
20
16
11
3
13
12
10
25
9

STEERING AND PROPULSION MEANS FOR SHIPS OR OTHER VESSELS

BACKGROUND OF THE INVENTION

This invention relates to steering and propulsion means for ships or other vessels.

Steering and propulsion means for ships and other vessels are known which are mountable in the bottom of a vessel and which are adapted to draw in water through an inlet opening which is usually in the bottom of the vessel and discharge the water, under pressure, through an outlet in the bottom of the vessel, the outlet comprising deflector means adapted to discharge the water under pressure as a stream or jet which will provide thrust having a substantially horizontal component, the deflector means being rotatable through 360° so that said stream or jet can be directed as required to provide both propulsion and steering. In smaller vessels such as barges and small ferries, such steering and propulsion means will generally be mounted at or towards the stern of the vessel and provide the sole means of propulsion and steering. In larger vessels, the steering and propulsion means will generally be mounted at or towards the bow of the vessel and will generally only be used during maneuvers at slow speed, e.g., when docking or berthing the vessel. Such a steering and propulsion means will hereinafter be referred to as "a steering and propulsion means of the kind described."

Known steering and propulsion means of the kind described have generally comprised a hollow casting defining a passage substantially in the form of an inverted "U," one end of the passage communicating with said inlet opening and the other end of the passage communicating with said outlet, suitable pump means being mounted in said passage for drawing water in through said inlet opening and discharging it, under pressure, through said outlet. Two shafts extend into said casing through suitable glands, one being a drive shaft one end of which is connected to said pump means and the other end of which is connectable to a suitable prime mover, and the other being a steering shaft, one end of which is connected to said deflector means and the other end of which is connectable to suitable steering control means. Examples of prior patents illustrating propulsion units are U.S. Pat. Nos. 3,800,731 and 3,543,713.

The known steering and propulsion means of the kind described are efficient in use, but suffer from the disadvantage that they are large in size and the casings thereof are large and complex in shape and therefore expensive to produce, whether by casting or by fabrication.

SUMMARY OF THE INVENTION

It is an object of the present invention to mount a propulsion unit within a cylindrical housing, with the drive shaft of the propulsion unit coaxial with the axis of the housing.

It is a further object of the present invention to provide a propulsion unit for a vessel wherein the propulsion unit is mounted within a flooded compartment.

It is a still further object of this invention to provide a vessel having a compartment watertightly sealed from the remainder of the vessel, with the compartment being flooded through at least one aperture in the vessel's hull.

It is still another object of this invention to mount a propulsion unit for a vessel within a housing such that the pump of the propulsion unit and a deflector at the outlet thereof are coaxial.

It is yet another object of the present invention to manufacture a housing for a propulsion unit for a vessel that is relatively inexpensive to produce and provides for a comparatively compact arrangement for the propulsion unit.

These and other objects of the present invention are attained in a propulsion unit for a vessel having a compartment watertightly sealed from the remainder of the vessel. The propulsion unit includes an open ended, vertically extending cylindrical member supported within the compartment. Pump means is mounted within the cylindrical member to propel a motivating fluid from the inlet of the cylindrical member to the outlet thereof. Deflector means is disposed adjacent the outlet of the cylindrical member to direct the motivating fluid in a substantially horizontal direction whereby a thrust is developed to move said vessel.

BRIEF DESCRIPTION OF THE DRAWING

The invention will be further described, by way of example, with reference to the accompanying drawing which shows in sectional elevation one embodiment of a steering and propulsion means according to the present invention mounted in a ship, only a very small portion of the ship being shown and this diagrammatically.

DESCRIPTION OF THE PREFERRED EMBODIMENT

Referring to the drawing, it will be seen that the steering and propulsion means according to the present invention comprises a cylindrical housing 1 having an upper open inlet end 2 and a lower open outlet end 3. Extending into the housing 1 and coaxial therewith is a drive shaft 4 on which is mounted for rotation therewith a pump rotor 5 adapted, in use, to draw water into the housing 1 through the inlet end 2 thereof and discharge the water, under pressure, through the outlet end 3 thereof. Immediately downstream of the pump rotor 5 is a stator or diffuser 6 for reducing turbulence in and directing the flow of water pumped by the pump rotor 5, the stator or diffuser 6 comprising a hub portion 7 and a series of radially extending static vanes 8, the radial outer edges of which are fixedly secured to the internal wall of the housing 1. At the outlet end of the housing 1 is a deflector means 9 fixedly mounted on a shaft 10 coaxial with the drive shaft 4 and the housing 1, the shaft 10 being rotatably journalled in bearings 11 mounted in the hub portion 7, the deflector means being adapted to direct the water under pressure from the pump rotor 5 as a stream or jet which will provide thrust having a substantially horizontal component when the steering and propulsion means is in use.

The deflector means 9 is provided with an external ring gear 12 which is in mesh with a pinion gear 13 fixedly mounted on the lower end of a steering shaft 14, the upper end of which is connected to suitable steering control means partially diagrammatically illustrated at 15. The steering shaft 14 is supported at its lower end by a bearing 16 and at its upper end by a combined bearing and watertight gland 17. The deflector means 9 is rotatable through 360° by rotation of the steering shaft 14 so that said stream or jet of water can be directed as required.

The steering and propulsion means is mounted in a tank or compartment 18 in the bottom of the ship 19. The tank or compartment 18 is watertightly sealed from the remainder of the ship and is defined on one side by the hull 20 of the ship, on the opposite side by either the hull of the ship or by a suitable side wall (not shown), by end walls (not shown) and by a top wall 21 having an aperture 22 therein closed by a cover plate 23. Apertures 24 in the hull 20 allow water to enter and flood the tank or compartment 18. The deflector means 9 is mounted in an aperture 25 in the bottom of the hull 20.

The steering and propulsion means is suspended from the cover plate 23 by suitable support columns 26, only one of which is shown. The support columns 26 are secured at their lower ends to an annular ring 27 welded or otherwise secured around the open inlet end 2 of the housing 1, the annular ring 27 providing a smooth nozzle-like entry for water into the inlet end 2 of the housing. The drive shaft 4 extends upwardly through a combined bearing and watertight gland 28 in the cover plate 23, the upper end of the drive shaft 4 being connectable, either directly or by way of suitable gearing, to a suitable prime mover (not shown) such as a suitable electric or hydraulic motor.

Guide means 29 is provided for guiding water entering the tank or compartment 18 through the apertures 24 in the hull 20 towards the open inlet end 2 of the housing.

It will be appreciated that since the housing of the propulsion means of the present invention is simply a straight cylinder open at both ends, the housing is easy and relatively inexpensive to produce while the "inline" disposition of the pump rotor and deflector means lends itself to a simple and relatively compact arrangement. Although the means of the present invention is required to be mounted in a tank or compartment watertightly sealed from the remainder of the vessel, such a tank or compartment is easily and inexpensively provided.

While a preferred embodiment of the present invention has been described and illustrated, it should be understood the invention should not be limited thereto, but may be otherwise embodied within the scope of the following claims.

I claim:

1. A propulsion unit for a vessel having a compartment watertightly sealed from the remainder of the vessel, said unit comprising:

an open ended, vertically extending cylindrical member supported within said compartment;

means mounted within said cylindrical member including pump means to propel a motivating fluid from the inlet of said cylindrical member to the outlet thereof, the inlet of said member being vertically positioned above said pump means and the outlet vertically below said pump means, and deflector means disposed adjacent the outlet of said cylindrical member to direct the motivating fluid in a substantially horizontal direction whereby a thrust is developed to move said vessel.

2. A propulsion unit in accordance with claim 1 wherein the cylindrical member is supported within a substantially flooded compartment.

3. A propulsion unit in accordance with claim 2 wherein the support for said cylindrical member includes an annular ring secured to the hull of the vessel to define a relatively smooth nozzle-like entry for the motivating fluid passing to the inlet of said cylindrical member.

4. A propulsion unit in accordance with claim 1 wherein the support for said cylindrical member includes an annular ring secured to the hull of the vessel to define a relatively smooth nozzle-like entry for the motivating fluid passing to the inlet of said cylindrical member.

5. A vessel comprising:

a compartment watertightly sealed from the remainder of the vessel;

a hollow cylindrical member vertically supported within said compartment, the top of said member defining an inlet for fluid and the bottom of said member defining an outlet therefor;

thrust means mounted within the cylindrical member intermediate the inlet and outlet thereof including pump means to propel said fluid from said inlet to said outlet of said member; and deflector means disposed adjacent the outlet of said cylindrical member to direct the motivating fluid in a substantially horizontal direction whereby a thrust is developed to move said vessel.

6. A vessel in accordance with claim 5 wherein the compartment is flooded by said fluid.

7. A vessel in accordance with claim 6 wherein the support for said cylindrical member includes an annular ring secured to the hull of the vessel and defining a relatively smooth nozzle-like entry for the motivating fluid passing to the inlet of said cylindrical member.

8. A vessel in accordance with claim 7 wherein at least one wall of the compartment is defined by the hull of the vessel; said one wall including at least one aperture through which water will flow to flood said compartment.

9. A vessel in accordance with claim 5 wherein the support for said cylindrical member includes an annular ring secured to the hull of the vessel and defining a relatively smooth nozzle-like entry for the motivating fluid passing to the inlet of said cylindrical member.

10. A vessel in accordance with claim 5 wherein at least one wall of the compartment is defined by the hull of the vessel; said one wall including at least one aperture through which water will flow to flood said compartment.

11. A propulsion unit for a vessel having a compartment watertightly sealed from the remainder of the vessel, said unit comprising:

a cylindrical housing vertically supported within said compartment, the upper open end of said housing defining an inlet and the lower open end defining an outlet;

pump means having a drive shaft extending into said housing coaxial therewith and including a pump rotor mounted on said drive shaft intermediate the inlet and outlet of said housing; and deflector means rotatably supported at the outlet of said housing about an axis coaxial with the axis of said drive shaft.

12. A propulsion unit in accordance with claim 11 wherein the housing is supported within a flooded compartment.

13. A propulsion unit in accordance with claim 12 wherein the support for said cylindrical member includes an annular ring secured to the hull of the vessel and defining a relatively smooth nozzle-like entry for the motivating fluid passing to the inlet of said cylindrical member.

14. A propulsion unit in accordance with claim 11 wherein the support for said cylindrical member includes an annular ring secured to the hull of the vessel and defining a relatively smooth nozzle-like entry for the motivating fluid passing to the inlet of said cylindrical member.

* * * * *

UNITED STATES PATENT AND TRADEMARK OFFICE

CERTIFICATE OF CORRECTION

PATENT NO. : 4,147,125

DATED : April 3, 1979

INVENTOR(S) : Owen G. Slade

It is certified that error appears in the above-identified patent and that said Letters Patent are hereby corrected as shown below:

[73] Assignee: "Carrier Corporation, Syracuse, New York" should read --Elliott Turbomachinery Limited, Isle of Wight, England--.

Signed and Sealed this

*Thirty-first* Day of *July 1979*

[SEAL]

*Attest:*

*Attesting Officer*

LUTRELLE F. PARKER

*Acting Commissioner of Patents and Trademarks*